US006998013B2

(12) United States Patent
Jan et al.

(10) Patent No.: US 6,998,013 B2
(45) Date of Patent: Feb. 14, 2006

(54) CMP APPARATUS POLISHING HEAD WITH CONCENTRIC PRESSURE ZONES

(75) Inventors: Chin-Tsan Jan, Hsinchu (TW); Jiann-Lih Wu, Hsin-chu (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 290 days.

(21) Appl. No.: 10/268,485

(22) Filed: Oct. 10, 2002

(65) Prior Publication Data

US 2004/0069406 A1 Apr. 15, 2004

(51) Int. Cl.
*B24B 49/00* (2006.01)

(52) U.S. Cl. ..... 156/345.13; 415/66

(58) Field of Classification Search ..... 156/345.12, 156/345.13; 451/66

See application file for complete search history.

(56) References Cited

U.S. PATENT DOCUMENTS 6,093,089 A * 7/2000 Chen et al. ..... 451/288
6,390,905 B1 * 5/2002 Korovin et al. ..... 451/286
6,506,105 B1 * 1/2003 Kajiwara et al. ..... 451/289
6,558,232 B1 * 5/2003 Kajiwara et al. ..... 451/41
6,582,277 B1 * 6/2003 Korovin ..... 451/5
6,623,343 B1 * 9/2003 Kajiwara et al. ..... 451/398
6,746,318 B1 * 6/2004 Mallery et al. ..... 451/285

FOREIGN PATENT DOCUMENTS

JP 06333891 A1 * 2/1994
JP 09174417 A1 * 8/1997

* cited by examiner

*Primary Examiner*—Parviz Hassanzadeh
*Assistant Examiner*—Sylvia R. MacArthur
(74) *Attorney, Agent, or Firm*—Tung & Associates

(57) ABSTRACT

A CMP polishing head having multiple concentric pressure zones for selectively increasing polishing pressure against selected regions of a semiconductor wafer in order to compensate for variations in polishing rates on the wafer surface otherwise caused by ridges or other non-uniformities in the wafer surface. The polishing head of the present invention comprises multiple, concentric, inflatable pressure rings each of which may be selectively inflated to increase the polishing pressure against a concentric ridge or material elevation on the corresponding concentric region of the wafer surface and increase the polishing rate of the concentric ridge or elevation between the rotating polishing head and a stationary polishing pad. A channel selector may be included in the polishing head for selectively aligning an air/pressure vacuum source with a selected one of multiple pressure tubes that connect to the respective pressure rings.

8 Claims, 3 Drawing Sheets

CMP APPARATUS POLISHING HEAD WITH CONCENTRIC PRESSURE ZONES

FIELD OF THE INVENTION

The present invention relates to chemical mechanical polishing apparatus used in the polishing of semiconductor wafers. More particularly, the present invention relates to a CMP apparatus polishing head which includes multiple concentric pressure zones for applying variable polishing pressure against various regions on a semiconductor wafer.

BACKGROUND OF THE INVENTION

In the fabrication of semiconductor devices from a silicon wafer, a variety of semiconductor processing equipment and tools are utilized. One of these processing tools is used for polishing thin, flat semiconductor wafers to obtain a planarized surface. A planarized surface is highly desirable on a shadow trench isolation (STI) layer, inter-layer dielectric (ILD) or on an inter-metal dielectric (IMD) layer, which are frequently used in memory devices. The planarization process is important since it enables the subsequent use of a high-resolution lithographic process to fabricate the next-level circuit. The accuracy of a high resolution lithographic process can be achieved only when the process is carried out on a substantially flat surface. The planarization process is therefore an important processing step in the fabrication of semiconductor devices.

A global planarization process can be carried out by a technique known as chemical mechanical polishing, or CMP. The process has been widely used on ILD or IMD layers in fabricating modern semiconductor devices. A CMP process is performed by using a rotating platen in combination with a pneumatically-actuated polishing head. The process is used primarily for polishing the front surface or the device surface of a semiconductor wafer for achieving planarization and for preparation of the next level processing. A wafer is frequently planarized one or more times during a fabrication process in order for the top surface of the wafer to be as flat as possible. A wafer can be polished in a CMP apparatus by being placed on a carrier and pressed face down on a polishing pad covered with a slurry of colloidal silica or aluminum.

A polishing pad used on a rotating platen is typically constructed in two layers overlying a platen, with a resilient layer as an outer layer of the pad. The layers are typically made of a polymeric material such as polyurethane and may include a filler for controlling the dimensional stability of the layers. A polishing pad is typically made several times the diameter of a wafer in a conventional rotary CMP, while the wafer is kept off-center on the pad in order to prevent polishing of a non-planar surface onto the wafer. The wafer itself is also rotated during the polishing process to prevent polishing of a tapered profile onto the wafer surface. The axis of rotation of the wafer and the axis of rotation of the pad are deliberately not collinear; however, the two axes must be parallel. It is known that uniformity in wafer polishing by a CMP process is a function of pressure, velocity and concentration of the slurry used.

A CMP process is frequently used in the planarization of an ILD or IMD layer on a semiconductor device. Such layers are typically formed of a dielectric material. A most popular dielectric material for such usage is silicon oxide. In a process for polishing a dielectric layer, the goal is to remove typography and yet maintain good uniformity across the entire wafer. The amount of the dielectric material removed is normally between about 5000 A and about 10,000 A. The uniformity requirement for ILD or IMD polishing is very stringent since non-uniform dielectric films lead to poor lithography and resulting window-etching or plug-formation difficulties. The CMP process has also been applied to polishing metals, for instance, in tungsten plug formation and in embedded structures. A metal polishing process involves a polishing chemistry that is significantly different than that required for oxide polishing.

Important components used in CMP processes include an automated rotating polishing platen and a wafer holder, which both exert a pressure on the wafer and rotate the wafer independently of the platen. The polishing or removal of surface layers is accomplished by a polishing slurry consisting mainly of colloidal silica suspended in deionized water or KOH solution. The slurry is frequently fed by an automatic slurry feeding system in order to ensure uniform wetting of the polishing pad and proper delivery and recovery of the slurry. For a high-volume wafer fabrication process, automated wafer loading/unloading and a cassette handler are also included in a CMP apparatus.

As the name implies, a CMP process executes a microscopic action of polishing by both chemical and mechanical means. While the exact mechanism for material removal of an oxide layer is not known, it is hypothesized that the surface layer of silicon oxide is removed by a series of chemical reactions which involve the formation of hydrogen bonds with the oxide surface of both the wafer and the slurry particles in a hydrogenation reaction; the formation of hydrogen bonds between the wafer and the slurry; the formation of molecular bonds between the wafer and the slurry; and finally, the breaking of the oxide bond with the wafer or the slurry surface when the slurry particle moves away from the wafer surface. It is generally recognized that the CMP polishing process is not a mechanical abrasion process of slurry against a wafer surface.

A schematic of a typical CMP apparatus is shown in FIGS. 1A and 1B. The apparatus 20 for chemical mechanical polishing includes a polishing head 8 which includes a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel.

In a CMP head, large variations in the removal rate, or polishing rate, across the whole wafer area are frequently observed. A thickness variation across the wafer is therefore produced as a major cause for wafer non-uniformity. In the improved CMP head design, even though a pneumatic system for forcing the wafer surface onto a polishing pad is used, the system cannot selectively apply different pressures at different locations on the surface of the wafer. Accordingly, while the CMP process provides a number of advantages over the traditional mechanical abrasion type polishing process, a serious drawback for the CMP process is the difficulty in controlling polishing rates at different locations on a wafer surface. Since the polishing rate applied to a wafer surface is generally proportional to the relative rotational velocity of the polishing pad, the polishing rate at a specific point on the wafer surface depends on the distance from the axis of rotation. In other words, the polishing rate obtained at the edge portion of the wafer that is closest to the rotational axis of the polishing pad is less than the polishing rate obtained at the opposite edge of the wafer. Even though this is compensated for by rotating the wafer surface during the polishing process such that a uniform average polishing rate can be obtained, the wafer surface, in general, is exposed to a variable polishing rate during the CMP process.

As shown in FIG. 1B, the surface profile of unpolished wafers 10 typically includes one or more annular, flat-topped ridges 23 which extend from the wafer surface 22. Because the wafer holder 14 of the polishing head 8 typically exerts uniform polishing pressure against all regions on the backside 28 of the wafer 10, this non-uniformity in the wafer surface profile causes difficulty in uniform polishing of the wafer surface 22 at the interface of the wafer surface 22 and the polishing pad 12. Some wafer holders 14 utilize a pressure membrane (not shown) at the center of the wafer holder 14 to exert extra pressure against the center region of the wafer 10 and thus, increase the polishing rate at the center relative to the peripheral regions of the wafer surface 22. While this ameliorates the non-uniform polishing rates between the central and peripheral regions of the wafer surface 22, non-uniformity in the polishing rates between the central and peripheral regions of the wafer surface 22, caused by the ridge or ridges 23, remains. Accordingly, a polishing head is needed which includes multiple pressure zones for applying pressure against various regions of a wafer in order to facilitate more uniform polishing rates among all regions on the wafer surface due to ridge or basin profiles in the wafer surface.

An object of the present invention is to provide a new and improved polishing head for a chemical mechanical polisher.

Another object of the present invention is to provide a new and improved polishing head which facilitates uniform polishing rates among multiple regions on a wafer surface during a chemical mechanical polishing process.

Still another object of the present invention is to provide a new and improved polishing head which includes multiple, independently-controlled pressure zones for increasing pressure against various regions of a wafer for uniform polishing of the wafer surface.

Yet another object of the present invention is to provide a new and improved CMP polishing head which facilitates improved polishing rates in the polishing of semiconductor wafers having a ridge or basin wafer surface profile.

A still further object of the present invention is to provide a CMP polishing head which utilizes a channel selector to select among one or more of multiple pressure zones which exert pressure against a wafer to facilitate substantially uniform polishing rates among all regions on the surface of the wafer.

Yet another object of the present invention is to provide a CMP polishing head which includes multiple concentric pressure rings that may be independently inflated and pressurized against selected concentric regions on a wafer interposed between the polishing head and a polishing pad in order to increase the polishing rate of the regions on the wafer pressurized against the polishing pad by the pressure ring or rings.

SUMMARY OF THE INVENTION

In accordance with these and other objects and advantages, the present invention is directed to a CMP polishing head having multiple concentric pressure zones for selectively increasing polishing pressure against selected regions of a semiconductor wafer in order to compensate for variations in polishing rates on the wafer surface otherwise caused by ridges or other non-uniformities in the wafer surface. The polishing head of the present invention comprises multiple, concentric, inflatable pressure rings each of which may be selectively inflated to increase the polishing pressure against a concentric ridge or material elevation on the corresponding concentric region of the wafer surface and increase the polishing rate of the concentric ridge or elevation between the rotating polishing head and a stationary polishing pad. A channel selector is typically included in the polishing head for selectively aligning an air/pressure vacuum source with a selected one of multiple pressure tubes that connect to the respective pressure rings.

BRIEF DESCRIPTION OF THE DRAWINGS

The invention will now be described, by way of example, with reference to the accompanying drawings, in which.

DESCRIPTION OF THE PREFERRED EMBODIMENTS

The present invention has particularly beneficial utility in the uniform polishing of semiconductor wafers having a non-uniform surface in the semiconductor fabrication industry. However, the invention is not so limited in application, and while references may be made to such semiconductor wafers, the present invention is more generally applicable to polishing substrates in a variety of mechanical and industrial applications.

Figure 2:
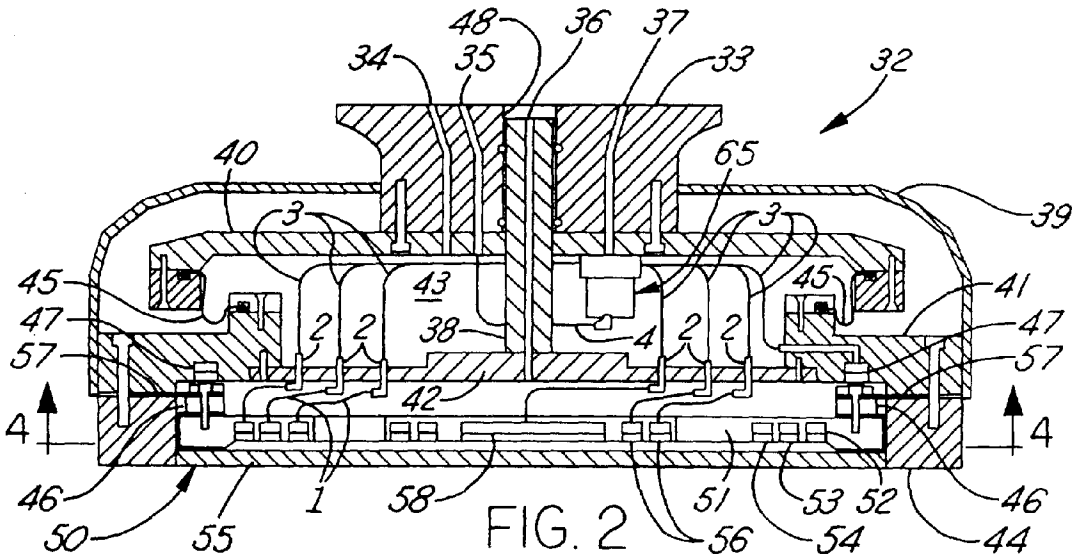
FIG. 2 is a cross-sectional view of an illustrative embodiment of the polishing head with concentric pressure zones of the present invention.

Referring initially to FIG. 2, a polishing head 32 of the present invention includes a housing 39 which is connected to a hub 33 supported on a drive shaft (not shown) to rotate therewith during polishing about an axis of rotation which is substantially perpendicular to the surface of a polishing pad (not shown) during polishing, as hereinafter described. The housing 39 may be circular in shape to correspond to the circular configuration of the substrate to be polished. A cylindrical bushing 48 may fit into a vertical bore extending through the hub 33. A frame 40 may be mounted on the hub 33 inside the housing 39. A base 41 is mounted inside the housing 39 beneath the frame 40. The frame 40 may be connected to the base 41 by a rolling diaphragm 45. The rolling diaphragm 45 seals the space between the frame 40 and the base 41 to define a loading chamber 43 between the frame 40 and the base 41. By delivery of air or nitrogen into the loading chamber 43 through a loading chamber passage 34 extending through the hub 33 and the frame 40, air or nitrogen pressure in the loading chamber 43 applies a downward pressure to the base 41 to control the vertical position of the base 41 relative to the polishing pad. A retainer ring 44 is mounted on the bottom of the base 41. A gimbel mechanism 42 mounted on the base 41 permits the base 41 to pivot with respect to the housing 39 such that the base 41 may remain substantially parallel with the surface of the polishing pad. The gimbel mechanism 42 includes a gimbel rod 38 which fits into a gimbel rod bore 48 extending through the hub 33 and the frame 40. The gimbel rod 38 may slide vertically along the gimbel rod bore 48 to impart vertical motion to the base 41, and prevents lateral motion of the base 41 with respect to the housing 39. A membrane duct passage 36 may extend through the gimbel rod 38 and the gimbel mechanism 42 for purposes which will be hereinafter described.

A substrate backing assembly 50 of the polishing head 32 includes a support plate 51 which is mounted to an annular support structure 46. The support structure 46 is connected to the base 41 by an annular flexure 57. An annular inner tube 47 may be provided in the base 41 and inflated to apply downward air or nitrogen pressure against the support structure 46, as hereinafter described. An outer pressure ring 52, a middle pressure ring 53 and an inner pressure ring 54 are supported by the support plate 51 in concentric relationship to each other. A pair of concentric inside pressure rings 56 may further be supported by the support plate 51, inside the inner pressure ring 54. An air- or nitrogen-actuated central membrane 58 may be further included in the center of the support plate 51. A channel selector 65 is mounted in the loading chamber 43, typically on the bottom surface of the frame 40, and is confluently connected to the outer pressure ring 52, the middle pressure ring 53, the inner pressure ring 54, the inside pressure rings 56 and the central membrane 58. The channel selector 65 inflates and deflates a selected one of the outer pressure ring 52, the middle pressure ring 53, the inner pressure ring 54, the inside pressure rings 56 and the central membrane 58, as hereinafter described. A flexible membrane 55 is mounted on the retainer ring 44 beneath the support plate 51.

Figure 5:
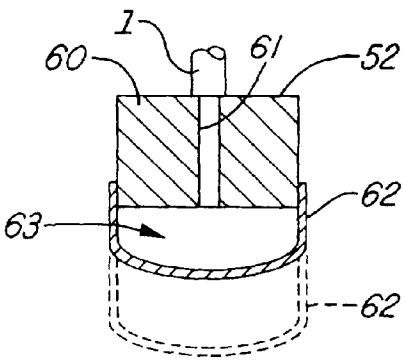
FIG. 5 is a cross-sectional view of a pressure ring component of the polishing head of the present invention.
Figure 1B:
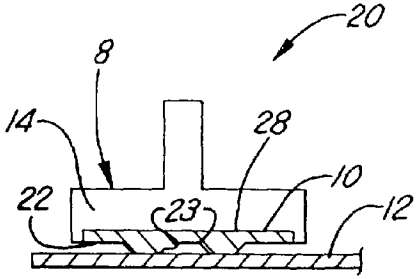
(PRIOR ART) FIG. 1B
FIG. 1B is a cross-sectional view of a typical conventional CMP apparatus during a CMP wafer polishing process, wherein the unpolished wafer includes an annular ridge or material elevation in the polishing surface thereof.
Figure 1A:
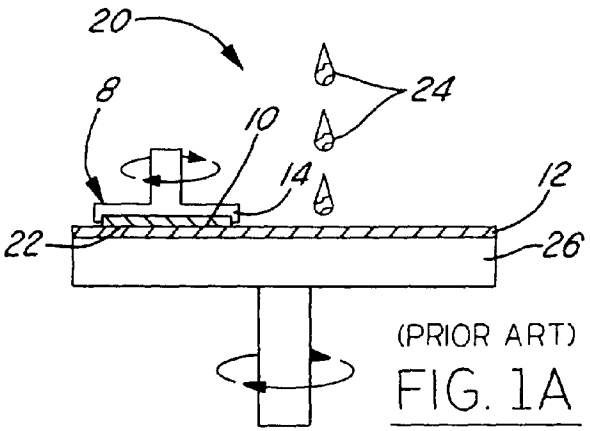
(PRIOR ART) FIG. 1A
FIG. 1A is a cross-sectional view of a typical conventional CMP apparatus during a CMP wafer polishing process.
Figure 4:
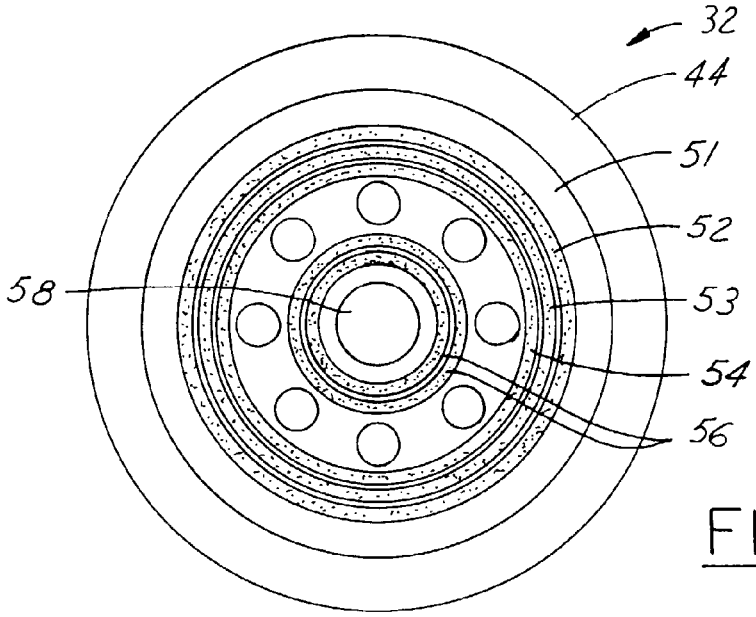
FIG. 4 is a cross-sectional view, taken along section lines 4—4 in FIG. 2, of the polishing head.

As shown in FIG. 4, in accordance with the present invention, the outer pressure ring 52, the middle pressure ring 53 and the inner pressure ring 54 are mounted on the support plate 51 in concentric relationship to each other. As shown in FIG. 5, each of the pressure rings 52–54 typically includes a ring support 60 which is mounted to the support plate 51; an air passage 61 which extends through the ring support 60; and a flexible, typically rubber ring membrane 62 which is pneumatically sealed against the ring support 60 to define a bladder 63. The channel selector 65 is confluently connected to the outer pressure ring 52, the middle pressure ring 53, the inner pressure ring 54, the inside pressure rings 56 and the central membrane 58 through respective proximal tubes 3, as shown in FIGS. 7A–7D, and distal tubes 1 which are connected to the proximal tubes 3 by respective tube connectors 2 that extend through the gimbel mechanism 42. The channel selector 65 is further confluently connected to the inner tube 47 through a proximal tube 3. The channel selector 65 is actuated by pressurized air or nitrogen and vacuum pressure alternately distributed through a channel selector air passage 35 extending through the hub 33 and through a channel selector tube 4 that connects the channel selector passage 35 to the channel selector 65. The channel selector 65 distributes pressurized air or nitrogen and vacuum pressure to a selected one of the outer pressure ring 52, the middle pressure ring 53, the inner pressure ring 54, the inside pressure rings 56, the central membrane 58 and the inner tube 47 by receiving the air, nitrogen or vacuum pressure through a pressure ring passage 37 extending through the hub 33 and the frame 40, respectively. The pressurized air or nitrogen or the vacuum pressure is distributed to the pressure rings 52–54, inside pressure ring 56, central membrane 58 or inner tube 47 through a corresponding one of the multiple proxmial tubes 3 and distal tubes 1.

Figure 3:
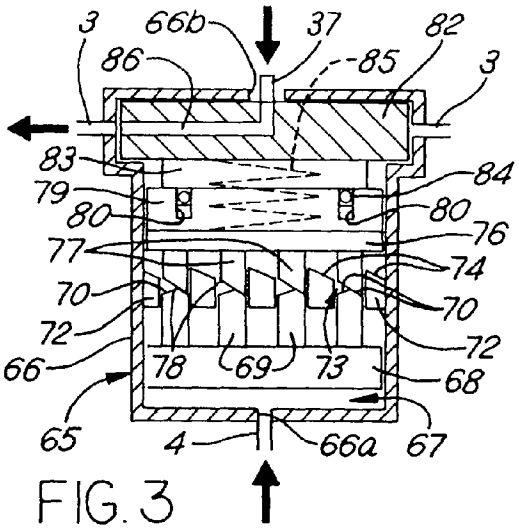
FIG. 3 is a cross-sectional view of a typical channel selector component of the polishing head of the present invention.

As shown in FIG. 3, the channel selector 65 typically includes a casing 66 which defines a casing interior 67. The channel selector tube 4 is disposed in fluid communication with the casing interior 67 through a casing opening 66*a*. A disc-shaped active ratchet wheel 68, having multiple ratchet fingers 69 extending upwardly therefrom in a circular pattern, is slidably disposed in the bottom portion of the casing interior 67. The upper, extending end of each ratchet finger 69 is terminated by a pair of bevels 70, which define a pointed configuration. A fixed ratchet wheel 72 is fixedly mounted to the casing 66, in the casing interior 67 above the active ratchet wheel 68. Multiple finger openings 73 extend through the fixed ratchet wheel 72 in a circular pattern for receiving the respective ratchet fingers 69 of the active ratchet wheel 68. Bevels 74 are provided in the upper surface of the fixed ratchet wheel 72, between the respective finger openings 73. A passive ratchet wheel 76 is slidably disposed in the casing interior 67 above the fixed ratchet wheel 72, and includes multiple downwardly-extending ratchet fingers 77 that are arranged in a circular pattern and are capable of removable insertion into the respective finger openings 73 of the fixed ratchet wheel 72 and engaging the ratchet fingers 69 of the active ratchet wheel 68 and the bevels 74 of the fixed ratchet wheel 72 to rotate the passive ratchet wheel 76, as hereinafter described. A bevel 78 is provided in the lower, extending end of each ratchet finger 77. A base collar 79 extends upwardly from the passive ratchet wheel 76 and includes tab slots 80. A duct roller 82, having a duct roller collar 83 extending downwardly therefrom, is rotatably disposed in the casing interior 67, above the passive ratchet wheel 76. The duct roller collar 83 is fitted with a pair of tabs 84 that slidably engage the respective tab slots 80 in the base collar 79 of the passive ratchet wheel 76. A spring 85 interposed between the duct roller 82 and the passive ratchet wheel 76 normally biases the passive ratchet wheel 76 downwardly, away from the duct roller 82. At least one L-shaped duct 86 extends through the duct roller 82, one end of which duct 86 is provided at the center of the duct roller 82, at an opening 66*b* in the casing 66, in confluent communication with the pressure ring air passage 37 (FIG. 2) which extends through the hub 33. The opposite end of the duct 86 is disposed in confluent communication with a selected one of the proximal tubes 3 (FIG. 2) leading to the outer pressure ring 52, the middle pressure ring 53, the inner pressure ring 54, the inside pressure rings 56 or the central membrane 58, respectively, depending on the position of the duct roller 82 in the casing interior 67. As shown in FIGS. 7A–7D, two or more of the ducts 86 may be provided in the duct roller 82 for simultaneous alignment with two or more of the proximal tubes 3. In that case, two or more of the outer pressure ring 52, the middle pressure ring 53, the inner pressure ring 54, the inside pressure rings 56 or the central membrane 58 may be pressurized simultaneously.

Figure 8:
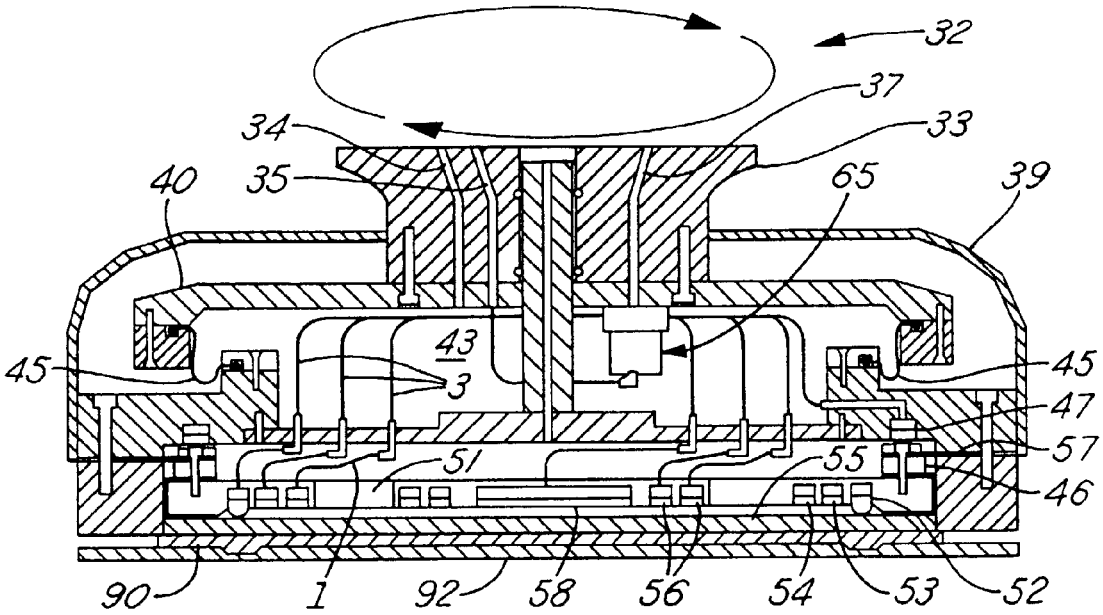
FIG. 8 is a cross-sectional view of the polishing head, illustrating inflation of one of the pressure rings in the polishing of a semiconductor wafer.
Figures 6A, 6B, 6C, 6D:
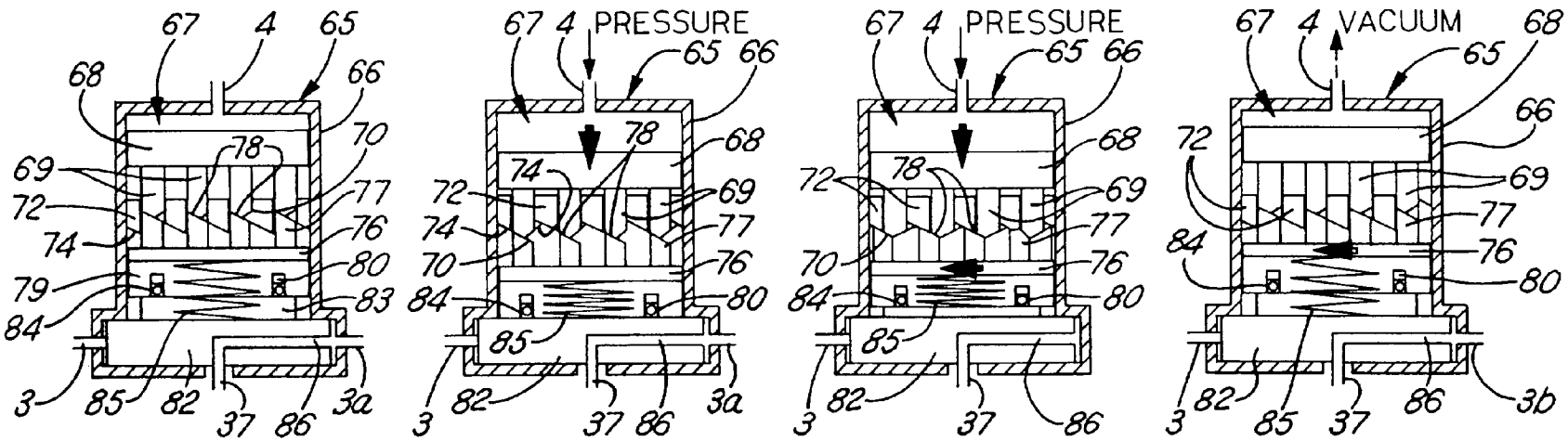
FIGS. 6A–6D are schematic cross-sectional views of the channel selector, illustrating successive positions of the channel selector interior components during switching from one pressure ring to another pressure ring in the polishing head.

FIGS. 6A–7D illustrate operation of the channel selector 65 to facilitate flow of pressurizing air or nitrogen or de-pressurizing vacuum pressure from the channel selector passage 35 (FIG. 2) to a selected one of the outer pressure ring 52, the middle pressure ring 53, the inner pressure ring 54, the inside pressure rings 56, the central membrane 58 and the inner tube 47. In FIGS. 6A and 7A, the air duct 86 in the duct roller 82 is initially disposed in confluent communication with a proximal tube 3*a* which establishes confluent communication between the pressure ring passage 37 and the distal tube 1 connected to the outer pressure ring 52, for example. Accordingly, pressurized air or nitrogen, typically at a pressure of up to about 10 psi, is capable of flowing through the pressure ring passage 37, the duct 86, the proximal tube 3*a*, the corresponding distal tube 1, and finally, into the bladder 63 (FIG. 5) of the outer pressure ring 52. The ring membrane 62 of the outer pressure ring 52 therefore expands, as shown by the dotted line in FIG. 5, and presses against the flexible membrane 55, as shown in FIG. 8. As the polishing head 32 is rotated in conventional fashion with a wafer 90 interposed between the flexible membrane 55 and the polishing pad 92, the flexible membrane 55 thus presses against the corresponding portion of the wafer 90 to enhance the polishing rate against that portion of the wafer 90, as hereinafter described.

Figures 7A, 7B, 7C, 7D:
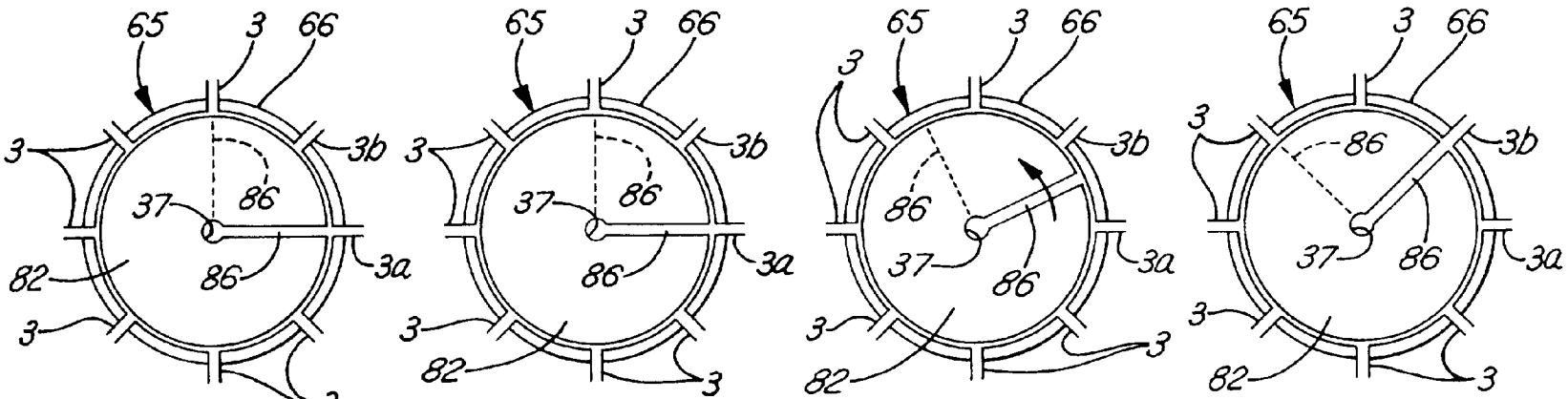
FIGS. 7A–7D correspond to FIGS. 6A–6D, respectively, and are schematic views of a duct roller component of the channel selector, illustrating successive positions of the duct roller during switching from one pressure ring to another pressure ring in the polishing head.

The outer pressure ring 52 may be deflated and one of the other pressure rings 53, 54, inside pressure rings 56, central membrane 58 or inner tube 47 inflated, as needed to achieve the desired relative polishing rates on the wafer 90, as follows. For purposes of explanation, the proximal tube 3*b* shown in FIGS. 6A–7D connects the channel selector 65 to the distal tube 1 which is connected to the middle pressure ring 53. Accordingly, the outer pressure ring 52 may deflated and the middle pressure ring 52 inflated to increase the polishing rate of a second annular region on the wafer 90, as needed, by initially applying vacuum pressure to the pressure ring passage 37 in the hub 33 (FIG. 2). Because the duct 86 is still aligned with the proximal tube 3*a* that communicates with the outer pressure ring 52, as shown in FIG. 7A, the vacuum pressure draws the pressurizing air or nitrogen in the outer pressure ring 52 from the bladder 63 (FIG. 5), through the distal tube 1, the proximal tube 3*a*, the duct 86 of the duct roller 82, and the pressure ring passage 37 in the hub 33, respectively. The channel selector 65 is then actuated to provide confluent communication between the pressure ring passage 37 and the middle pressure ring 53, as follows.

First, pressurized air or nitrogen is distributed through the channel selector passage 35 in the hub 33, through the channel selector tube 4 and into the casing interior 67 of the channel selector 65, respectively. As shown in FIG. 6B, the pressurized air or nitrogen impinges against the active ratchet wheel 68, slidably displacing it in the casing interior 67 such that the ratchet fingers 69 of the active ratchet wheel 68 extend through the respective finger openings 73 (FIG. 3) of the fixed ratchet wheel 72. The moving ratchet fingers 69 engage and push against the respective ratchet fingers 77 of the passive ratchet wheel 76, against the bias imparted by the spring 85, beyond the respective bevels 74 of the fixed ratchet wheel 72. Due to the sloped configuration of the bevels 74 of the fixed ratchet wheel 72, the bevels 78 of the ratchet fingers 77 of the passive ratchet wheel 76 slide on the bevels 74 of the fixed ratchet wheel 72 as the spring 85 simultaneously pushes the passive ratchet wheel 76 against the fixed ratchet wheel 72. This causes the passive ratchet wheel 76 to rotate in the counterclockwise direction, as shown in FIG. 6C, as the bevels 78 of the passive ratchet wheel 76 slide against the respective bevels 74 of the fixed ratchet wheel 72. Simultaneously, the tabs 84 on the duct roller collar 83 are engaged by the tab slots 80 on the base collar 79 of the passive ratchet wheel 78, such that the duct roller 82 rotates with the passive ratchet wheel 78, as shown in FIG. 7C. The spring 85, combined with vacuum pressure applied to the casing interior 67 through the channel selector air tube 4, as shown in FIG. 6D, finally displaces the passive ratchet wheel 76 in the casing interior 67 such that the ratchet fingers 77 of the passive ratchet wheel 76 are again inserted in the respective finger openings 73 of the fixed ratchet wheel 72. At this point, the duct 86 is disposed in fluid communication with the proximal tube 3*b*, as shown in FIG. 7D. Accordingly, the middle pressure ring 53 is inflated by introducing pressurized air or nitrogen through the pressure ring passage 37, the duct 86, the proximal tube 3*b*, the corresponding distal tube 1 and into the middle pressure ring 53, respectively. The middle pressure ring 53 is deflated and one or more of the inner pressure ring 54, the inside pressure rings 56, the central membrane 58 or the inner tube 47 pressurized with air or nitrogen, typically at a pressure of up to about 10 psi, by operating the channel selector 65 to incrementally establish confluent communication between the pressure ring passage 37 and the appropriate proximal tube 3 which corresponds to the inner pressure ring 54, the inside pressure rings 56, the central membrane 58 or the inner tube 47, in the same manner as heretofore described with respect to the transition between the proximal tube 3*a* and the proximal tube 3*b*.

Figure 8A:
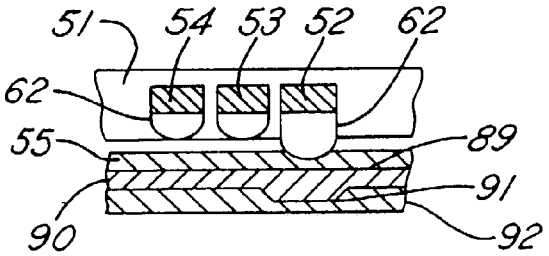
FIG. 8A is a cross-sectional view of the inflated pressure ring of FIG. 8.

Referring next to FIGS. 8 and 8A, in application of the polishing head 32, a wafer 90 is mounted in a face-down position on the flexible membrane 55, typically according to conventional methods for mounting the wafer 90 on CMP polishing heads. The wafer 90 typically includes one or more annular ridges 91 protruding from the face thereof, as shown in FIG. 8A, and the pressure rings 52–54, as well as the inside pressure rings 56, may be selectively pressurized with air or nitrogen to facilitate enhanced polishing uniformity of all areas on the surface of the wafer 90, including the ridges 91. Accordingly, as the polishing head 32 is rotated, the flexible membrane 55 presses the wafer 90 against a polishing pad 92 of a CMP apparatus. The polishing pad 92 removes wafer material from the surface of the wafer 90 to provide a substantially uniform surface for the subsequent fabrication of integrated circuit devices on the wafer 90. As shown in FIG. 8A, in the event that a ridge or other elevation 91 on the surface of the wafer 90 is located beneath the outer pressure ring 52 of the polishing head 32, the outer pressure ring 52 is pressurized with air or nitrogen at a pressure of up to typically about 10 psi in the manner heretofore described with respect to FIGS. 2 and 6A–7D. Accordingly, the pressurized outer pressure ring 52 applies extra downward pressure against the flexible membrane 55 which, in turn, applies the pressure against the backside 89 of the wafer 90, directly above the ridge 91. This extra pressure applied to the ridge 91 against the polishing pad 92 causes polishing of the ridge 91 at a faster rate than polishing of the flat areas on the wafer 90, resulting in a more uniform polishing rate among all regions on the wafer 90. The outer pressure ring 52 may be deflated and one of the other pressure rings 53, 54, inside pressure rings 56, or central membrane 58 inflated by actuation of the channel selector 65, as heretofore described, to apply increased pressure at the respective regions of the wafer 90 which correspond to the locations of the pressure rings 53, 54, inside pressure rings 56, or central membrane 58 above the wafer 90, as needed to increase the polishing rate at those locations on the wafer 90. Pressurized air or nitrogen may be introduced into the loading chamber 43 through the loading chamber passage 34 to pressurize the loading chamber 43. The inner tube 47 may be pressurized by introducing pressurized air or nitrogen through the appropriate proximal tube 3 and into the inner tube 47 by operation of the channel selector 65, as heretofore described. Accordingly, the inner tube 47 inflates and exerts downward pressure against the support plate 51 through the support structure 46 to apply extra polishing pressure, as needed, to the support plate 51.

While the preferred embodiments of the invention have been described above, it will be recognized and understood that various modifications can be made in the invention and the appended claims are intended to cover all such modifications which may fall within the spirit and scope of the invention.

What is claimed is:

1. A polishing head for polishing a substrate on a polishing apparatus, comprising:

a housing for mounting on the apparatus;

a support plate carried by said housing;

a flexible membrane carried by said housing;

at least three substantially concentric pressure rings carried by said support plate for inflation against said flexible membrane and pressing said flexible membrane against the substrate to increase a polishing rate of selected regions on the substrate; and a channel selector comprising a casing carried by said housing, a duct roller having a duct rotatably mounted in said casing for fluid communication of said duct with a selected one of said at least three pressure rings for reversibly inflating said selected one of said at least three pressure rings, and a duct roller rotating mechanism for rotating said duct roller in said casing.

2. The polishing head of claim 1 further comprising at least one inside pressure ring carried by said support plate in substantially concentric relationship to said at least three pressure rings for inflation against said flexible membrane and pressing said flexible membrane against the substrate and wherein said duct of said duct roller is adapted for fluid communication with said at least one inside pressure ring for selectively inflating said at least one inside pressure ring.

3. The polishing head of claim 1 further comprising a central membrane carried by said support plate for inflation against said flexible membrane and pressing said flexible membrane against the substrate and wherein said duct of said duct roller is adapted for fluid communication with said central membrane for selectively inflating said central membrane.

4. The polishing head of claim 3 further comprising at least one inside pressure ring carried by said support plate in substantially concentric relationship to said at least three pressure rings for inflation against said flexible membrane and pressing said flexible membrane against the substrate and wherein said duct of said duct roller is adapted for fluid communication with said at least one inside pressure ring for selectively inflating said at least one inside pressure ring.

5. The polishing head of claim 1 wherein said duct roller rotating mechanism comprises a passive ratchet wheel rotatably mounted in said causing for rotation with said duct roller and an active ratchet wheel operably engaging said passive ratchet wheel for incrementally rotating said active ratchet wheel and said duet roller in said casing for fluid communication of said duct with said selected one of said at least three pressure rings.

6. The polishing head of claim 5 further comprising at least one inside pressure ring carried by said support plate in substantially concentric relationship to said at least three pressure rings for inflation against said flexible membrane and pressing said flexible membrane against the substrate and wherein said duct of said duct roller is adapted for fluid communication with said at least one inside pressure ring for selectively inflating said at least one inside pressure ring.

7. The polishing head of claim 5 further comprising a central membrane carried by said support plate for inflation against said flexible membrane and pressing said flexible membrane against the substrate and wherein said duct of said duct roller is adapted for fluid communication with said central membrane for selectively inflating said central membrane.

8. The polishing head of claim 7 further comprising at least one inside pressure ring carried by said support plate in substantially concentric relationship to said at least three pressure rings for inflation against said flexible membrane and pressing said flexible membrane against the substrate and wherein said duct of said duct roller is adapted for fluid communication with said at least one inside pressure ring for selectively inflating said at least one inside pressure ring.

* * * * *